US006561620B2

(12) United States Patent
Pietrzyk et al.

(10) Patent No.: US 6,561,620 B2
(45) Date of Patent: May 13, 2003

(54) CARRIAGE SKIRT FOR INKJET PRINTER

(75) Inventors: Joe R. Pietrzyk, deceased, late of San Diego, CA (US), by Susan L. Pietrzyk, legal representative; Grant Allen Webster, Valley Center, CA (US); Michael Daniel Kurzer, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 65 days.

(21) Appl. No.: 09/844,011

(22) Filed: Apr. 27, 2001

(65) Prior Publication Data

US 2002/0158940 A1 Oct. 31, 2002

(51) Int. Cl.[7] ..... B41J 2/165
(52) U.S. Cl. ..... 347/34; 347/83
(58) Field of Search ..... 347/34, 83, 22, 347/25

(56) References Cited

U.S. PATENT DOCUMENTS

| | | | | |
|---|---|---|---|---|
| 3,983,801 | A | 10/1976 | Watanabe et al. | 347/125 |
| 4,077,040 | A | 2/1978 | Hendriks | 347/78 |
| 4,369,450 | A | 1/1983 | Iwagami et al. | 347/34 |
| 4,411,706 | A | 10/1983 | Wallace et al. | 134/37 |
| 4,520,366 | A | 5/1985 | Cragin, Jr. | 347/74 |
| 4,591,869 | A | 5/1986 | Katerberg et al. | 347/21 |
| 4,940,998 | A | 7/1990 | Asakawa | 347/37 |
| 5,625,398 | A | 4/1997 | Milkovits et al. | 347/104 |
| 5,774,141 | A | 6/1998 | Cooper et al. | 347/34 |
| 5,877,788 | A | 3/1999 | Haan et al. | 347/28 |
| 6,203,152 | B1 | 3/2001 | Boleda et al. | 347/102 |

FOREIGN PATENT DOCUMENTS

| | | |
|---|---|---|
| JP | 2261651 | 10/1990 |
| JP | 9039256 | 2/1997 |
| JP | 11001001 | 1/1999 |
| JP | 11001001 A | 1/1999 |
| JP | 2000108330 | 4/2000 |
| JP | 2001138548 | 5/2001 |
| WO | WO 01/87618 | 11/2001 |

OTHER PUBLICATIONS

Amended Search Report under Section 17, Application No. GB 0208379.8, dated May 31, 2002, (1 pg.). Gary Williams.

*Primary Examiner*—Shih-Wen Hsieh

(57) ABSTRACT

An inkjet printer for printing on a print medium includes at least one print cartridge, a carriage shell adapted to hold the at least one print cartridge and traverse the print medium, and a carriage skirt extending from the carriage shell. The at least one print cartridge includes a printhead having a scan axis and a plurality of ink orifices formed in a front face thereof. The carriage shell traverses the print medium along the scan axis during printing and the carriage skirt extends from the carriage shell substantially parallel with the front face of the printhead in a direction of the scan axis.

34 Claims, 5 Drawing Sheets

CARRIAGE SKIRT FOR INKJET PRINTER

THE FIELD OF THE INVENTION

The present invention relates generally to inkjet printers, and more particularly to an inkjet printer having a carriage skirt which extends beyond a print cartridge of the inkjet printer to influence airflow between the print cartridge and a print medium during printing.

BACKGROUND OF THE INVENTION

As illustrated in FIG. 1, a portion of a conventional inkjet printer 90 includes a printer carriage 91 and a print cartridge 92 installed in the printer carriage. The print cartridge includes a printhead 93 which ejects or fires ink drops 94 through a plurality of orifices or nozzles 95 and toward a print medium 96, such as a sheet of paper, so as to print a dot of ink on the print medium. Typically, the orifices are arranged in one or more columns or arrays such that properly sequenced ejection of ink from the orifices causes characters or other images to be printed upon the print medium as the print cartridge and the print medium are moved relative to each other. In one arrangement, the print medium is held stationary as the print cartridge traverses the print medium to create a band or swath of print on the print medium. The print swath has a length, measured along a scan axis of the print cartridge, and a height, measured perpendicular to the scan axis along a paper advance axis of the print medium.

Image quality and performance of inkjet printing is rapidly approaching that of silver halide photographs and offset printing. The greatest improvement in image quality has been achieved by increasing image resolution which is a measure of the number of dots printed per height of an image, for example, dots-per-inch. Image resolution has been increased by reducing orifice spacing of the printhead and reducing a volume of the ink drops with an understanding that the volume of an ink drop corresponds to a size of the dot formed on the print medium. By reducing the orifice spacing of the printhead and the size of the ink drops, an image becomes sharper, less grainy, and more detailed.

As orifice spacing and drop volume decrease to increase image resolution, however, it becomes necessary to operate the printhead at higher firing frequencies and faster printing speeds to achieve the same throughput. Unfortunately, smaller, more closely spaced ink drops ejected at higher firing frequencies are more greatly influenced by surrounding air than larger, more widely spaced ink drops ejected at lower firing frequencies. In addition, when the printer carriage and the print cartridge move relative to the print medium in a printing direction, as indicated by arrow 97, for example, a stagnant region of air is created at a leading end of the printer carriage and the print cartridge, as indicated by region 98 in FIG. 1.

As printing speed and, therefore, speed of the printer carriage and the print cartridge increases, a high pressure region develops at the leading end of the printer carriage and the print cartridge which forces more air under the print cartridge and generates air currents between the printhead and the print medium. The air currents, however, misdirect the ink drops as they are ejected toward the print medium. Unfortunately, misdirection of the ink drops yields images which have undesirable print defects or artifacts, such as swath height error.

Swath height error is characterized by a variation in the height of the print swath created by the ink drops as the printer carriage and the print cartridge move relative to the print medium during printing. One cause of swath height error is the stagnant region of air created at the leading end of the printer carriage and the print cartridge during printing. As such, the stagnant region of air contributes to air currents which cause a misdirection of the trajectories of the ink drops in a positive or outward manner thereby resulting in a diminishing and/or increasing swath height.

Attempts to mask or hide these print defects have utilized multi-pass print modes, reduced printing speeds, one direction printing, and/or reduced spacing between the print cartridge and the print medium (i.e., printhead-to-paper spacing). These attempts, however, are leading in a direction contrary to the desired direction of inkjet printer advancement, such as single-pass print modes, faster printing speeds for higher throughput, bi-directional printing, increased printhead-to-paper spacing for accommodating a greater range of print medium thickness, and higher resolution, lower drop volume printheads.

Accordingly, a need exists for an inkjet printer which substantially eliminates objectionable print defects, such as swath height error, caused by air currents generated by printing operations, without compromising image resolution, printing speed, and/or print medium flexibility.

SUMMARY OF THE INVENTION

One aspect of the present invention provides an inkjet printer for printing on a print medium. The inkjet printer includes at least one print cartridge, a carriage shell adapted to hold the at least one print cartridge, and a carriage skirt extending from the carriage shell. The at least one print cartridge includes a printhead having a scan axis and a plurality of ink orifices formed in a front face thereof. As such, the carriage shell is adapted to traverse the print medium along the scan axis and the carriage skirt extends from the carriage shell substantially parallel with the front face of the printhead in a direction of the scan axis.

In one embodiment, the carriage skirt further extends from the carriage shell substantially parallel with the front face of the printhead in a direction substantially perpendicular to the scan axis.

In one embodiment, the carriage skirt extends a first distance in the direction of the scan axis and extends a second distance in the direction substantially perpendicular to the scan axis. As such, the second distance is less than the first distance.

In one embodiment, the carriage skirt extends from the carriage shell substantially parallel with the front face of the printhead in a second direction of the scan axis opposite the first named direction of the scan axis.

In one embodiment, the carriage skirt has a surface oriented substantially parallel with and substantially co-planar with the front face of the printhead.

In one embodiment, the plurality of ink orifices of the printhead form at least one column of ink orifices. As such, the carriage skirt extends from the carriage shell in a direction substantially perpendicular to the at least one column of ink orifices.

In one embodiment, the printhead is adapted to eject ink drops through the ink orifices and into a print zone between the printhead and the print medium during printing. In one embodiment, the carriage skirt influences airflow through the print zone during printing. In one embodiment, the carriage skirt reduces a component of the airflow oriented substantially perpendicular to the scan axis during printing. In one embodiment, the carriage skirt produces substantially uniform airflow through the print zone during printing.

In one embodiment, the carriage skirt affects air currents acting on the ink drops during printing to prevent print defects caused by the air currents.

In one embodiment, the carriage skirt reduces air pressure at a leading end of the at least one print cartridge when the carriage shell traverses the print medium during printing.

In one embodiment, the at least one print cartridge includes a plurality of print cartridges and the carriage shell is adapted to hold the plurality of print cartridges. As such, the carriage skirt has at least one opening defined therein which is configured to accommodate at least one of the plurality of print cartridges.

In one embodiment, the plurality of print cartridges are arranged to include a leading print cartridge and a trailing print cartridge when the carriage shell traverses the print medium during printing. As such, a first portion of the carriage skirt extends from the carriage shell adjacent the leading print cartridge and a second portion of the carriage skirt extends from the carriage shell adjacent the trailing print cartridge.

Another aspect of the present invention provides a method of printing on a print medium with an inkjet printer including at least one printhead having a scan axis and a plurality of ink orifices formed in a front face thereof. The method includes supporting the at least one printhead in a carriage shell and traversing the print medium with the at least one printhead along the scan axis, ejecting ink drops through the ink orifices into a print zone between the at least one printhead and the print medium during printing, and affecting airflow in the print zone while ejecting the ink drops through the ink orifices during printing. Affecting airflow in the print zone includes influencing airflow through the print zone by extending a carriage skirt from the carriage shell substantially parallel with the front face of the at least one printhead in a direction of the scan axis.

Another aspect of the present invention provides a carriage adapted to hold at least one print cartridge of an inkjet printer. The at least one print cartridge includes a printhead having a plurality of ink orifices formed in a front face thereof. As such, the carriage includes a shell adapted to support the at least one print cartridge for movement along a scan axis and a skirt extending from the shell in a direction of the scan axis such that the skirt is configured to extend substantially parallel with the front face of the printhead when the at least one print cartridge is supported by the shell.

Another aspect of the present invention provides a method of forming a carriage for at least one print cartridge of an inkjet printer. The at least one print cartridge includes a printhead having a plurality of ink orifices formed in a front face thereof. As such, the method includes providing a shell adapted to support the at least one print cartridge for movement along a scan axis and extending a skirt from the shell in a direction of the scan axis such that the skirt is configured to extend substantially parallel with the front face of the printhead when the at least one print cartridge is supported by the shell.

The present invention provides an inkjet printer which influences airflow between a print cartridge of the inkjet printer and a print medium to affect air currents acting on ink drops ejected from the print cartridge during printing. More specifically, the inkjet printer reduces or eliminates a component of airflow oriented substantially perpendicular to a scan axis of the print cartridge to produce substantially uniform airflow between the print cartridge and the print medium during printing. As such, undesirable print defects, such as a variation in height of a print swath created by the print cartridge during printing, are avoided.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "left," "right," "leading,"" trailing," etc., is used with reference to the orientation of the Figure(s) being described. The inkjet printer and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
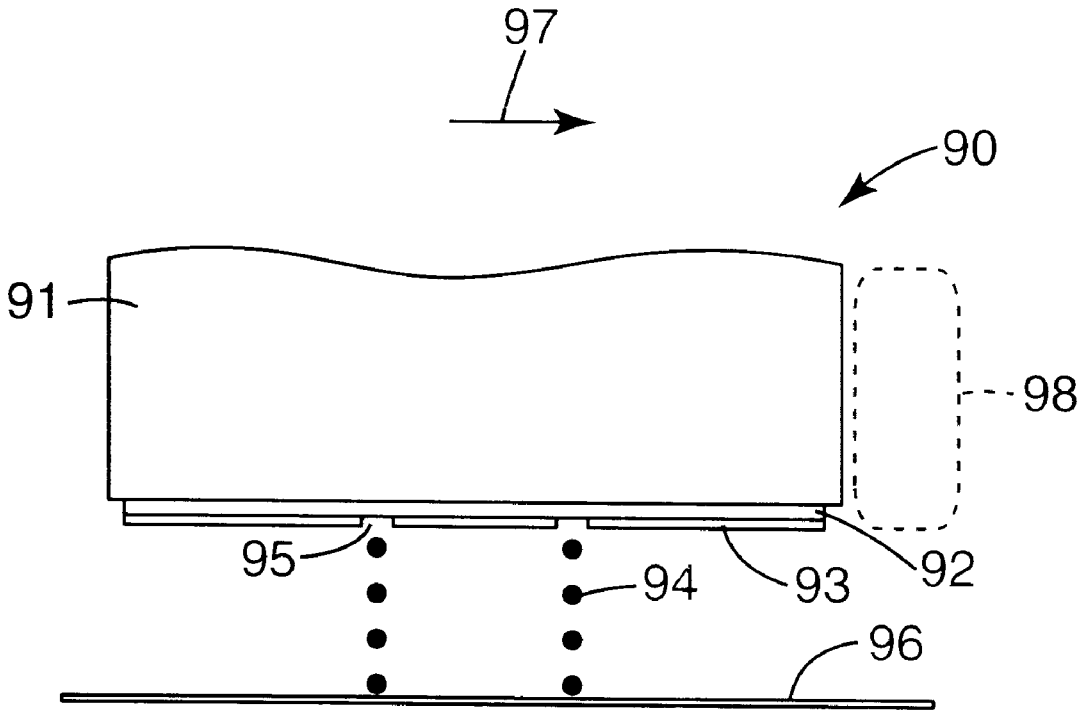
Fig. 1 PRIOR ART
FIG. 1 is a side schematic view of a portion of a prior art inkjet printer.
Figure 2:
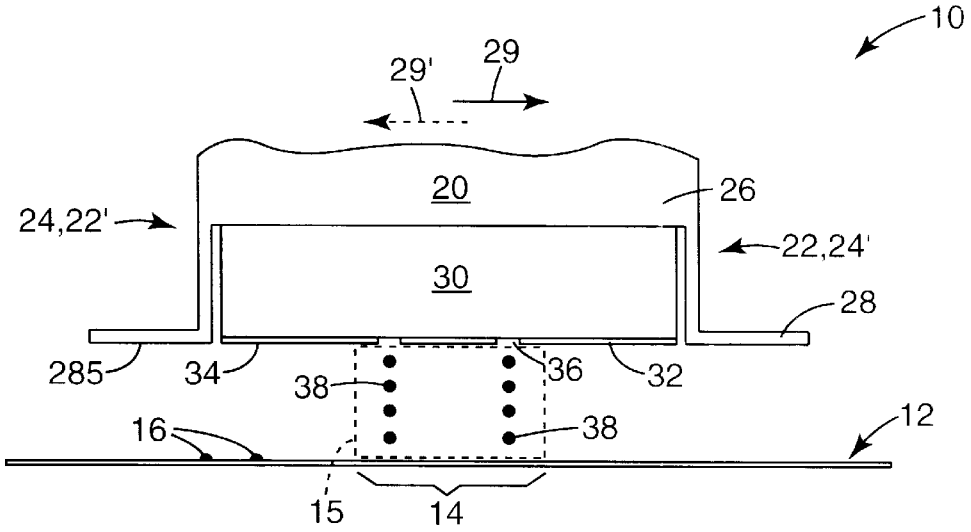
FIG. 2 is a side schematic view of one embodiment of a portion of an inkjet printer including a carriage skirt according to the present invention.
Figure 3:
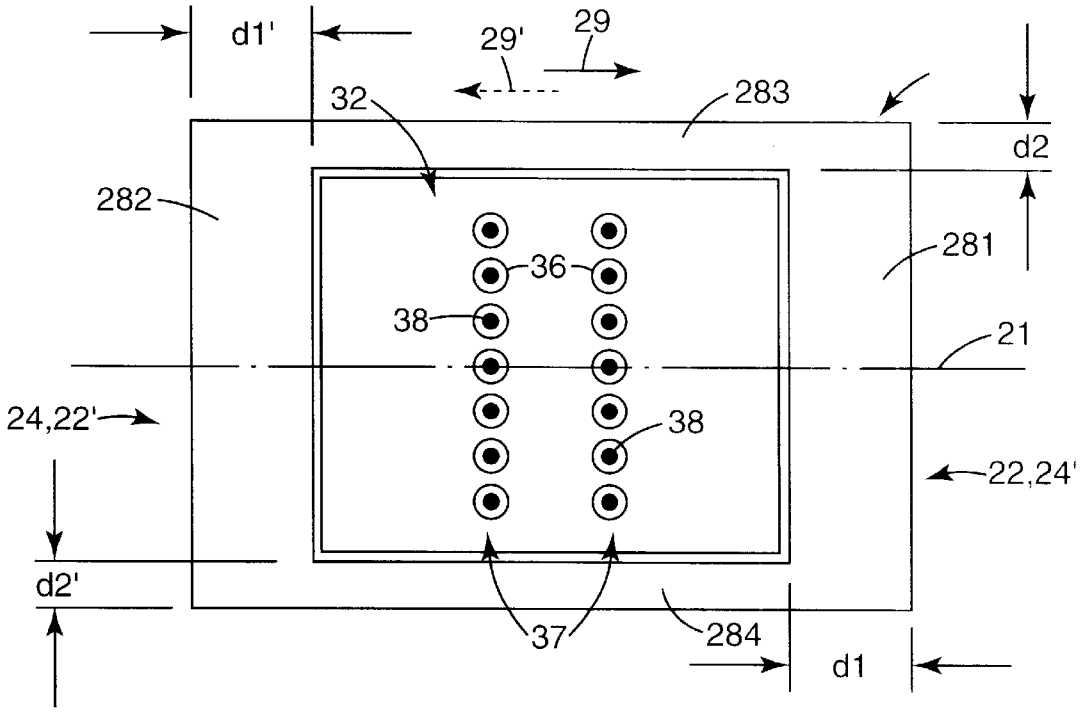
FIG. 3 is a bottom schematic view of the inkjet printer of FIG. 2.

FIGS. 2 and 3 illustrate one embodiment of a portion of an inkjet printer 10 for printing on a print medium 12. Inkjet printer 10 includes a printer carriage 20 and a print cartridge 30. Print medium 12 includes a print region 14 within which print 16 in the form of characters and/or graphics is created as relative movement between print cartridge 30 and print medium 12 occurs during printing. Print medium 12 is any type of suitable material, such as paper, cardstock, transparencies, Mylar, and the like.

During printing, print medium 12 is held stationary as printer carriage 20 and print cartridge 30 move in a printing direction, as indicated by arrow 29, to traverse print medium 12 and create print 16. Upon completing a row of print 16, print medium 12 is advanced in a direction substantially perpendicular to the printing direction indicated by arrow 29 (i.e., in and out of the plane of the paper). Thereafter, print medium 12 is held stationary as printer carriage 20 and print cartridge 30 move in a printing direction, as indicated by arrow 29', opposite the printing direction indicated by arrow 29, to traverse print medium 12 and create another row of print 16.

Printer carriage 20 is slidably supported within a housing (not shown) of inkjet printer 10 for travel back and forth across print medium 12, and print cartridge 30 is installed in printer carriage 20 for movement with printer carriage 20 during printing. Print cartridge 30 includes a printhead 32 having a front face 34 in which a plurality of ink orifices or nozzles 36 are formed in a manner well known to those skilled in the art. It is understood that printhead 32 may include one or more columns or other arrays of ink orifices 36.

Example embodiments of printhead 32 include a thermal printhead, a piezoelectric printhead, a flex-tensional printhead, or any other type of inkjet ejection device known in the art. If printhead 32 is, for example, a thermal printhead, printhead 32 typically includes a substrate layer (not shown) having a plurality of resistors (not shown) which are operatively associated with ink orifices 36. Upon energization of the resistors, in response to command signals delivered by a controller (not shown) to print cartridge 30, drops of ink 38 are ejected through ink orifices 36 toward print medium 12.

Ink drops 38 are ejected through ink orifices 36 and from printhead 32 into a print zone 15 with an intended ink drop trajectory. Print zone 15 is defined as being between printhead 32 and print medium 12, and encompasses ink drops 38. As such, print zone 15, as well as print region 14 of print medium 12, move with print cartridge 30 during printing. The intended ink drop trajectory is defined by a plurality of ink drops 38 ejected toward print medium 12 to form a trail of ink drops 38 extending between printhead 32 and print medium 12.

Printer carriage 20, including print cartridge 30 and printhead 32, has a scan axis 21 along which printer carriage 20 and, therefore, print cartridge 30 and printhead 32 traverses during printing. As such, printer carriage 20, including print cartridge 30 and printhead 32, has a leading end 22 and a trailing end 24 when printer carriage 20 moves in the printing direction indicated by arrow 29 and a leading end 22' and a trailing end 24' when printer carriage 20 moves in the printing direction indicated by arrow 29', opposite the printing direction indicated by arrow 29. Since print cartridge 30 and, therefore, printhead 32 are installed in printer carriage 20 for movement with printer carriage 20 during printing, scan axis 21 represents a scan axis of print cartridge 30 and printhead 32. In addition, leading ends 22 and 22' and trailing ends 24 and 24' of printer carriage 20 represent leading ends and trailing ends, respectively, of print cartridge 30 and printhead 32.

In one embodiment, printer carriage 20 includes a carriage shell 26 and a carriage skirt 28. Carriage shell 26 is configured to hold print cartridge 30 and is mounted in inkjet printer 10 for lateral movement relative to print medium 12. As such, carriage shell 26 supports print cartridge 30, including printhead 32, for movement back and forth across print medium 12. Thus, carriage shell 26 and print cartridge 30, including printhead 32, traverse print medium 12 along scan axis 21.

In one embodiment, carriage skirt 28 extends from carriage shell 26 substantially parallel with front face 34 of printhead 32. In addition, carriage skirt 28 extends from carriage shell 26 in a direction of scan axis 21. As such, carriage skirt 28 includes a first portion 281 which extends from one end of carriage shell 26 in the direction of scan axis 21. More specifically, first portion 281 extends from leading end 22 of printer carriage 20 in a first direction of scan axis 21. First portion 281 extends, for example, in the direction indicated by arrow 29. Thus, first portion 281 extends from leading end 22 of printer carriage 20 when printer carriage 20 and print cartridge 30 move in the direction indicated by arrow 29.

Carriage skirt 28, however, also includes a second portion 282 which extends from an opposite end of carriage shell 26 also in the direction of scan axis 21. More specifically, second portion 282 extends from trailing end 22 of printer carriage 20 in a second direction of scan axis 21. Second portion 282 extends, for example, in the direction opposite the direction indicated by arrow 29. Thus, second portion 282 extends from trailing end 22 of printer carriage 20 when printer carriage 20 and print cartridge 30 move in the direction indicated by arrow 29. Accordingly, when printer carriage 20 and print cartridge 30 move in the direction indicated by arrow 29', second portion 282 extends from leading end 22' of printer carriage 20 and first portion 281 extends from tailing end 22' of printer carriage 20.

In one embodiment, carriage skirt 28 also extends from carriage shell 26 in a direction substantially perpendicular to scan axis 21. More specifically, carriage skirt 28 includes a third portion 283 which extends from one side of carriage shell 26 and a fourth portion 284 which extends from an opposite side of carriage shell 26. As such, third portion 283 extends from one side of carriage shell 26 in a first direction substantially perpendicular to scan axis 21 and fourth portion 284 extends from an opposite side of carriage shell 26 in a second direction substantially perpendicular to scan axis 21.

In one embodiment, carriage skirt 28 extends from carriage shell 26 a distance d1 in the direction of scan axis 21 and extends from carriage shell 26 a distance d2 in the direction substantially perpendicular to scan axis 21. As such, first portion 281 extends distance d1 in the direction indicated by arrow 29 and second portion 282 extends distance d1' in the direction indicated by arrow 29', opposite the direction indicated by arrow 29. In addition, third portion 283 extends distance d2 in one direction substantially perpendicular to the direction indicated by arrow 29 and fourth portion 284 extends distance d2' in an opposite direction substantially perpendicular to the direction indicated by arrow 29. It is understood that distances d1 and d1' may or may not be equal. In addition, distances d2 and d2' may or may not be equal. Furthermore, distances d1 and d1' may or may not be equal to distances d2 and d2'.

In one embodiment, distance d2 is less than distance d1. In one illustrative embodiment, for example, distance d1 is approximately 10 millimeters or greater and distance d2 is approximately 5 millimeters or greater. Distances d1 and d2 (including distances d1' and d2') are a function of printing parameters such as a scan speed of printer carriage 20, a printhead-to-paper spacing between printhead 32 and print medium 12, and/or a drop velocity, volume, and/or momentum of ink drops 38 during printing. Preferably, distances d1 and d2 are scaled or tuned, for example, to a scan speed of printer carriage 20 to produce substantially uniform airflow through print zone 15 in a scan direction of printer carriage 20. In one embodiment, distance d1 and distance d2 are measured from an edge of print cartridge 30 and/or printhead 32.

In one embodiment, ink orifices 36 of printhead 32 are arranged in one or more columns 37. As such, each column 37 of ink orifices 36 is oriented substantially perpendicular to scan axis 21. Thus, carriage skirt 28 extends from carriage shell 26 in a direction substantially perpendicular to columns 37 of ink orifices 36. More specifically, first portion 281 and second portion 282 of carriage skirt 28 each extend from carriage shell 26 in a direction substantially perpendicular to columns 37.

In one embodiment, carriage skirt 28 has a surface 285 which is oriented substantially parallel with front face 34 of printhead 32. In addition, surface 285 is oriented substantially co-planar with front face 34 of printhead 32. As such, surface 285 of carriage skirt 28 and front face 34 of printhead 32 define a substantially continuous plane oriented substantially parallel with print region 14 of print medium 12 during printing.

In one embodiment, carriage skirt 28 is formed integrally with carriage shell 26. In another embodiment, however, carriage skirt 28 is formed separately from carriage shell 26. As such, carriage skirt 28 is secured or attached to carriage shell 26 for movement with carriage shell 26 during printing.

Figure 4:
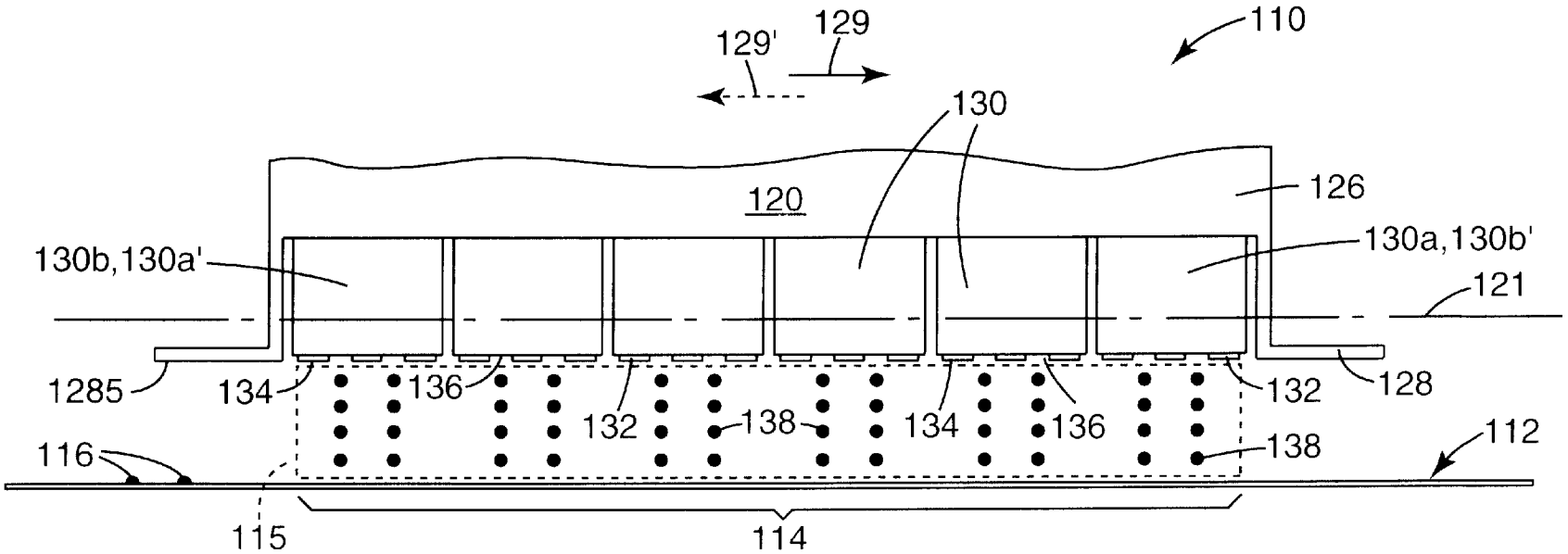
FIG. 4 is a side schematic view of another embodiment of an inkjet printer including a carriage skirt according to the present invention.
Figure 5:
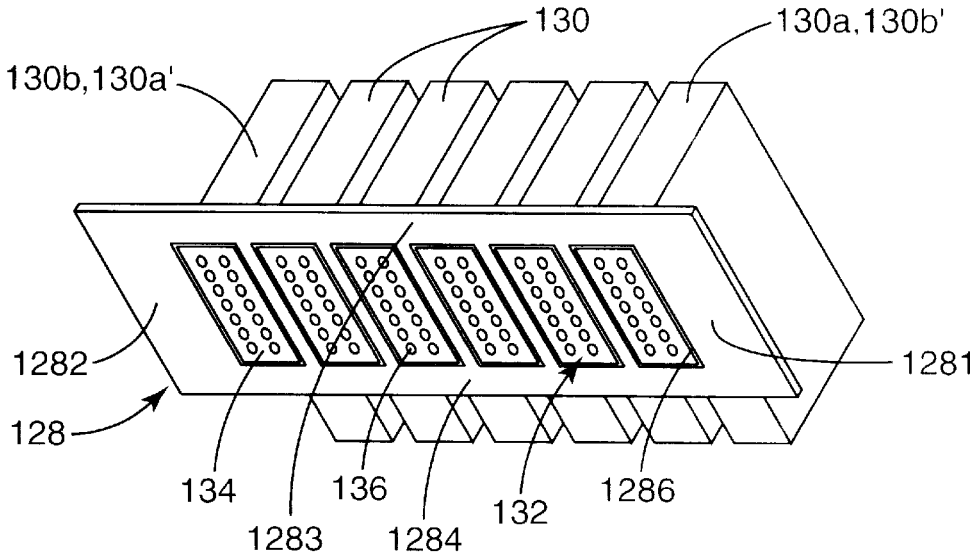
FIG. 5 is a bottom perspective view of a portion of the inkjet printer of FIG. 4.
Figure 6:
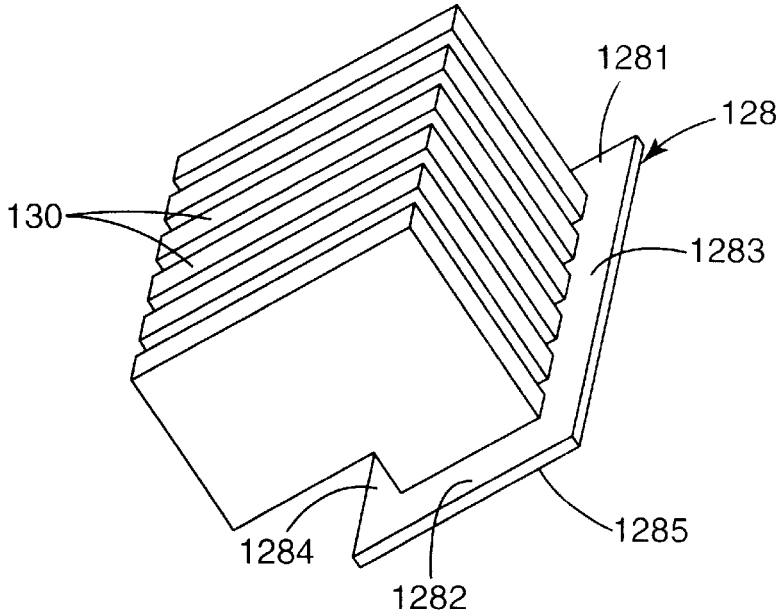
FIG. 6 is a top perspective view of a portion of the inkjet printer of FIG. 4.

FIGS. 4–6 illustrate another embodiment of a portion of inkjet printer 10. Inkjet printer 110 includes a printer carriage 120 and a plurality of print cartridges 130. Print cartridges 130 are each similar to print cartridge 30 and include a printhead 132 having a front face 134 in which a plurality of ink orifices 136 are formed. As such, ink drops 138 are ejected through ink orifices 136 and into a print zone 115 between printhead 132 and print medium 112 as relative movement between print cartridges 130 and print medium 112 occurs during printing. Thus, print medium 112 includes a print region 114 within which print 116 in the form of characters and/or graphics is created as ink drops 138 are ejected into print zone 115 during printing.

Print cartridges 130 may eject the same or differing colors of ink drops 138 during printing. In addition, all or less than all print cartridges 130 may be operated at one time. While inkjet printer 110 is illustrated as including six print cartridges 130, it is within the scope of the present invention for inkjet printer 110 to include any number of print cartridges 130.

Printer carriage 120 has a scan axis 121 along which printer carriage 120 and, therefore, print cartridges 130 traverse during printing. As such, print cartridges 130 are arranged to include a leading print cartridge 130*a* and a trailing print cartridge 130*b* when printer carriage 120 moves in the printing direction indicated by arrow 129, and a leading print cartridge 130*a*' and a trailing print cartridge 130*b*' when printer carriage 120 moves in the printing direction indicated by arrow 129', opposite the printing direction indicated by arrow 129.

Printer carriage 120 is similar to printer carriage 20 and includes a carriage shell 126 and a carriage skirt 128. As such, carriage shell 126 is configured to hold print cartridges 130 and is mounted in inkjet printer 110 for lateral movement relative to print medium 112. Thus, carriage shell 126 supports print cartridges 130 for movement back and forth across print medium 112.

Carriage skirt 128 is similar to carriage skirt 28 and extends substantially parallel with front faces 134 of printheads 132. As such, a surface 1285 of carriage skirt 128 is oriented substantially parallel with and substantially co-planar with front faces 134 of printheads 132. In addition, carriage skirt 128 extends from carriage shell 126 in a manner similar to how carriage skirt 28 extends from carriage shell 26, as described above. As such, carriage skirt 128 extends in a direction of scan axis 121 as well as in a direction substantially perpendicular to scan axis 121.

Carriage skirt 128 includes a first portion 1281 and a second portion 1282 which extend from opposite ends of carriage shell 128 in opposite directions of scan axis 121. In addition, carriage skirt 128 includes a third portion 1283 and a fourth portion 1284 which extend from opposite sides of carriage shell 126 in opposite directions substantially perpendicular to scan axis 121. Thus, when printer carriage 120 and print cartridges 130 move in the direction indicated by arrow 129, first portion 1281 of carriage skirt 128 extends from carriage shell 126 adjacent leading print cartridge 130*a* and second portion 1282 of carriage skirt 128 extends from carriage shell 126 adjacent trailing print cartridge 130*b*. Accordingly, when printer carriage 120 and print cartridges 130 move in the direction indicated by arrow 129', opposite the printing direction indicated by arrow 129, second portion 1282 of carriage skirt 128 extends from carriage shell 126 adjacent leading print cartridge 130*a*' and first portion 1281 of carriage skirt 128 extends from carriage shell 126 adjacent trailing print cartridge 130*b*'.

In one embodiment, carriage skirt 128 has a plurality of openings 1286 defined therein in which print cartridges 130 are positioned. As such, each opening 1286 accommodates one print cartridge 130. It is, however, within the scope of the present invention for carriage skirt 128 to have one or more openings 1286 defined therein in each of which one or more print cartridges 130 are positioned. Print cartridges 130 are positioned in openings 1286 such that front faces 34 of printheads 132 are flush with carriage skirt 128 and, more specifically, surface 1285 of carriage skirt 128. As such, surface 1285 of carriage skirt 128 and front faces 134 of printheads 132 define a substantially continuous plane oriented substantially parallel with print region 114 of print medium 112.

Figure 7:
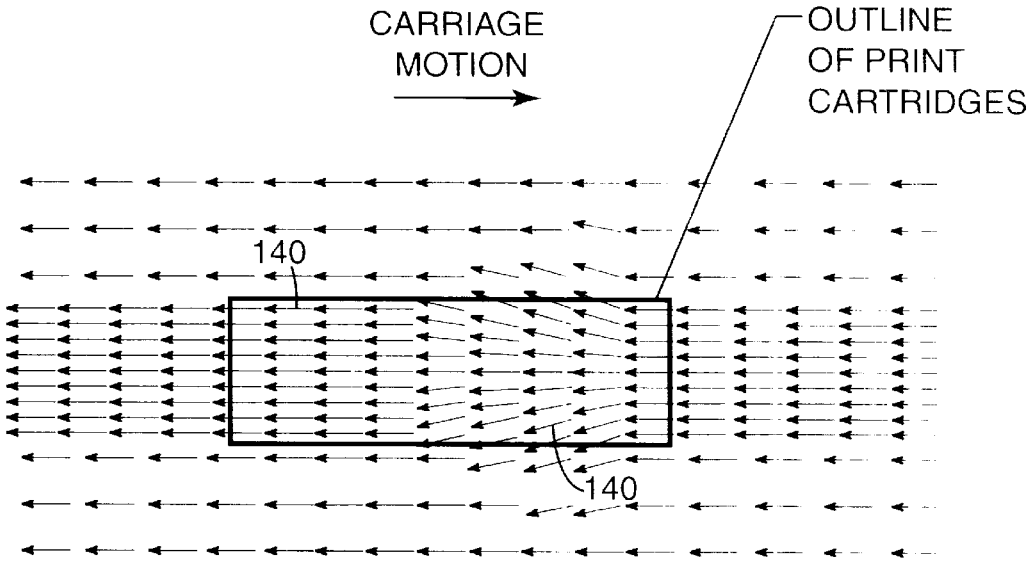
FIG. 7 is a graphical representation of airflow in a horizontal plane between a print medium and a printhead of an inkjet printer without a carriage skirt according to the present invention.
Figure 8:
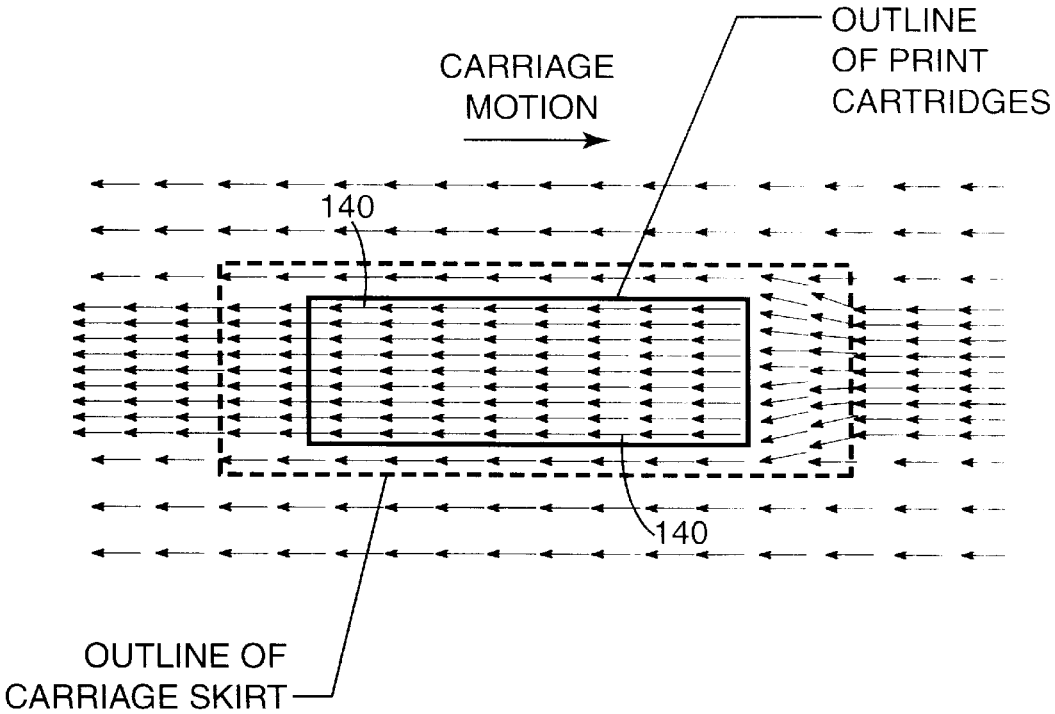
FIG. 8 is a graphical representation of airflow in a horizontal plane between a print medium and a printhead of an inkjet printer with a carriage skirt according to the present invention.

FIGS. 7 and 8 illustrate airflow between, for example, print medium 112 and print cartridges 130 of inkjet printer 110 without and with, respectively, a carriage skirt according to the present invention. More specifically, FIG. 7 illustrates airflow, as represented by arrows 140, under print cartridges 130 without carriage skirt 128 as printer carriage 120 and print cartridges 130 move relative to print medium 112 in the direction indicated by arrow 129. Arrows 140 represent velocity vectors relative to movement of printer carriage 120.

Without carriage skirt 128, for example, airflow under print cartridges 130 includes a component oriented substantially perpendicular to scan axis 121. Airflow under print cartridges 130, therefore, is generally non-uniform or non-parallel airflow. As such, air flowing under print cartridges 130 pushes or deflects ink drops 138 outward. Ink drops 138 from end nozzles or orifices 136 of leading print cartridge 130*a*, for example, are most affected. Thus, the height of a print swath created by an inkjet printer without a carriage skirt varies in the direction substantially perpendicular to scan axis 121 and causes a print defect, referred to as swath height error. In addition, air stagnates in front of printer carriage 120 and print cartridges 130 as printer carriage 120 and print cartridges 130 move along scan axis 121. As such, a high pressure region which forces more air under printer carriage 120 and print cartridges 130 is created in front of printer carriage 120.

FIG. 8 also illustrates airflow, as represented by arrows 140, under print cartridges 130 with carriage skirt 128 as printer carriage 120 and print cartridges 130 move relative to print medium 112 in the direction indicated by arrow 129. Arrows 140 represent velocity vectors relative to movement of printer carriage 120.

With carriage skirt 128, for example, a component of airflow oriented substantially perpendicular to scan axis 121 under print cartridges 130 is reduced or eliminated. As such, carriage skirt 128 produces substantially uniform, parallel airflow in print zone 115 between printheads 132 of print cartridges 130 and print medium 112. Airflow through print zone 115 with carriage skirt 128, therefore, is more uniform than without carriage skirt 128. Thus, air flowing under print cartridges 130 does not push or deflect ink drops 138 outward. In addition, if air stagnates in front of printer carriage 120 and print cartridges 130 as printer carriage 120 and print cartridges 130 move along scan axis 121, air stagnates above carriage skirt 128. Furthermore, more air flows over and around print cartridges 130 rather than under print cartridges 130. Thus, swath height error is reduced or eliminated with carriage skirt 128.

By extending carriage skirts 28 and 128 from carriage shells 26 and 126, respectively, carriage skirts 28 and 128 of printer carriages 20 and 120 influence airflow through print zones 15 and 115, respectively, during printing. More specifically, carriage skirts 28 and 128 affect air currents acting on ink drops 38 and 138 by reducing or eliminating a component of airflow oriented substantially perpendicular to scan axes 21 and 121 under print cartridges 30 and 130, respectively. As such, carriage skirts 28 and 128 produce substantially uniform airflow between print cartridges 30 and 130 and print mediums 12 and 112, respectively, during printing. In addition, carriage skirts 28 and 128 reduce air pressure at a leading end of print cartridges 30 and 130 when printer carriages 20 and 120 traverse print mediums 12 and 112, respectively, during printing. Thus, carriage skirts 28 and 128 prevent print defects, including swath height error, caused by air currents generated during printing.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printer for printing on a print medium, the inkjet printer comprising:

at least one print cartridge including a printhead having a scan axis and a plurality of ink orifices formed in a front face thereof;

a carriage shell adapted to hold the at least one print cartridge and traverse the print medium along the scan axis; and a carriage skirt extending from the carriage shell substantially parallel with and substantially co-planar with the front face of the printhead in a direction of the scan axis away from the printhead, wherein the carriage skirt has at least one opening defined therein which is configured to accommodate the at least one print cartridge.

2. The inkjet printer of claim 1, wherein the carriage skirt further extends from the carriage shell substantially parallel with and substantially co-planar with the front face of the printhead in a direction substantially perpendicular to the scan axis away from the printhead.

3. The inkjet printer of claim 2, wherein the carriage skirt extends a first distance in the direction of the scan axis and extends a second distance in the direction substantially perpendicular to the scan axis, wherein the second distance is less than the first distance.

4. The inkjet printer of claim 1, wherein the carriage skirt extends from the carriage shell substantially parallel with and substantially co-planar with the front face of the printhead in a second direction of the scan axis away from the printhead opposite the first named direction of the scan axis.

5. The inkjet printer of claim 1, wherein the plurality of ink orifices of the printhead form at least one column of ink orifices, wherein the carriage skirt extends from the carriage shell away from the printhead in a direction substantially perpendicular to the at least one column of ink orifices.

6. The inkjet printer of claim 1, wherein the printhead is adapted to eject ink drops through the ink orifices and into a print zone between the printhead and the print medium during printing.

7. The inkjet printer of claim 6, wherein the carriage skirt influences airflow through the print zone during printing.

8. The inkjet printer of claim 7, wherein the carriage skirt reduces a component of the airflow oriented substantially perpendicular to the scan axis during printing.

9. The inkjet printer of claim 6, wherein the carriage skirt produces substantially uniform airflow through the print zone during printing.

10. The inkjet printer of claim 6, wherein the carriage skirt affects air currents acting on the ink drops during printing to prevent print defects caused by the air currents.

11. The inkjet printer of claim 1, wherein the carriage skirt reduces air pressure at a leading end of the at least one print cartridge when the carriage shell traverses the print medium during printing.

12. The inkjet printer of claim 1, wherein the at least one print cartridge includes a plurality of print cartridges, wherein the carriage shell is adapted to hold the plurality of print cartridges, and wherein the at least one opening of the carriage skirt is configured to accommodate at least one of the plurality of print cartridges.

13. The inkjet printer of claim 12, wherein the plurality of print cartridges are arranged to include a leading print cartridge and a trailing print cartridge when the carriage shell traverses the print medium during printing, wherein a first portion of the carriage skirt extends from the carriage shell adjacent the leading print cartridge and a second portion of the carriage skirt extends from the carriage shell adjacent the trailing print cartridge.

14. A method of printing on a print medium with an inkjet printer including at least one printhead having a scan axis and a plurality of ink orifices formed in a front face thereof, the method comprising the steps of:

supporting the at least one printhead in a carriage shell and traversing the print medium with the at least one printhead along the scan axis;

ejecting ink drops through the ink orifices into a print zone between the at least one printhead and the print medium during printing; and affecting airflow in the print zone while ejecting the ink drops through the ink orifices during printing, including influencing airflow through the print zone by extending a carriage skirt from the carriage shell substantially parallel with and substantially co-planar with the front face of the at least one printhead in a direction of the scan axis away from the printhead, wherein the carriage skirt has at least one opening defined therein which is configured to accommodate the at least one printhead.

15. The method of claim 14, wherein the step of affecting airflow in the print zone includes affecting air currents acting on the ink drops during printing to prevent print defects caused by the air currents.

16. The method of claim 14, wherein the step of affecting airflow in the print zone includes reducing air pressure at a leading end of the at least one printhead during printing.

17. The method of claim 14, wherein the step of affecting airflow in the print zone includes producing substantially uniform airflow in the print zone during printing.

18. The method of claim 14, wherein influencing airflow through the print zone includes reducing a component of the airflow oriented substantially perpendicular to the scan axis during printing.

19. The method of claim 14, wherein influencing airflow through the print zone includes influencing airflow through the print zone by extending the carriage skirt from the carriage shell substantially parallel with and substantially co-planar with the front face of the at least one printhead in a direction substantially perpendicular to the scan axis away from the at least one printhead.

20. The method of claim 14, wherein influencing airflow through the print zone includes influencing airflow through the print zone by extending the carriage skirt from the carriage shell substantially parallel with and substantially co-planar with the front face of the at least one printhead in a second direction of the scan axis away from the at least one printhead opposite the first named direction of the scan axis.

21. The method of claim 14, wherein the plurality of ink orifices of the at least one printhead form at least one column of ink orifices, and wherein influencing airflow through the print zone includes influencing airflow through the print zone by extending the carriage skirt from the carriage shell away from the at least one printhead in a direction substantially perpendicular to the at least one column of ink orifices.

22. A carriage adapted to hold at least one print cartridge of an inkjet printer, the at least one print cartridge including a printhead having a plurality of ink orifices formed in a front face thereof, the carriage comprising:

a shell adapted to support the at least one print cartridge for movement along a scan axis; and a skirt extending from the shell in a direction of the scan axis, wherein the skirt has at least one opening defined therein which is configured to accommodate the at least one print cartridge and is configured to extend away from the printhead substantially parallel with and substantially co-planar with the front face of the printhead when the at least one print cartridge is supported by the shell.

23. The carriage of claim 22, wherein the skirt further extends from the shell in a direction substantially perpendicular to the scan axis.

24. The carriage of claim 23, wherein the skirt extends a first distance in the direction of the scan axis and extends a second distance in the direction substantially perpendicular to the scan axis, wherein the second distance is less than the first distance.

25. The carriage of claim 23, wherein the skirt extends from the shell in a second direction of the scan axis opposite the first named direction of the scan axis.

26. The carriage of claim 22, wherein the skirt is adapted to influence airflow across the front face of the printhead when the at least one print cartridge is supported by the shell during printing.

27. The carriage of claim 26, wherein the skirt is adapted to reduce a component of the airflow oriented substantially perpendicular to the scan axis during printing.

28. The carriage of claim 22, wherein the skirt is adapted to produce substantially uniform airflow across the front face of the printhead when the at least one print cartridge is supported by the shell during printing.

29. The carriage of claim 22, wherein the skirt is adapted to affect air currents acting on ink drops ejected from the ink orifices during printing to prevent print defects caused by the air currents.

30. The carriage of claim 22, wherein the carriage is adapted to hold a plurality of print cartridges, wherein the shell is adapted to support the plurality of print cartridges, and wherein the at least one opening of the skirt is configured to accommodate at least one of the plurality of print cartridges.

31. A method of forming a carriage for at least one print cartridge of an inkjet printer, the at least one print cartridge including a printhead having a plurality of ink orifices formed in a front face thereof, the method comprising the steps of:

providing a shell adapted to support the at least one print cartridge for movement along a scan axis; and extending a skirt from the shell in a direction of the scan axis, wherein the skirt has at least one opening defined therein which is configured to accommodate the at least one print cartridge and is configured to extend away from the printhead substantially parallel with and substantially co-planar with the front face of the printhead when the at least one print cartridge is supported by the shell.

32. The method of claim 31, further comprising the step of:

extending the skirt from the shell in a direction substantially perpendicular to the scan axis.

33. The method of claim 32, wherein the step of extending the skirt from the shell in the direction of the scan axis includes extending the skirt a first distance in the direction of the scan axis, and wherein the step of extending the skirt from the shell in a direction substantially perpendicular to the scan axis includes extending the skirt a second distance in the direction substantially perpendicular to the scan axis, wherein the second distance is less than the first distance.

34. The method of claim 31, further comprising the step of:

extending the skirt from the shell in a second direction of the scan axis opposite the first named direction of the scan axis.

* * * * *